US006001225A

United States Patent [19]

Bushman

[11] Patent Number: 6,001,225

[45] Date of Patent: Dec. 14, 1999

[54] CATALYTICALLY COATED ANODES

[76] Inventor: James B. Bushman, 6395 Kennard Rd., Medina, Ohio 44256

[21] Appl. No.: 08/961,685

[22] Filed: Oct. 31, 1997

Related U.S. Application Data

[60] Provisional application No. 60/029,529, Oct. 31, 1996.

[51] Int. Cl.[6] ..... C23F 13/00

[52] U.S. Cl. ..... 204/196.38; 204/290 R; 204/291; 204/294

[58] Field of Search ..... 204/290 R, 290 F, 204/196, 197, 196.38, 294, 291

[56] References Cited

U.S. PATENT DOCUMENTS 3,924,025 12/1975 Kolb et al. ..... 204/290 F 4,318,795 3/1982 Bianchi et al. ..... 204/290 F 4,457,821 7/1984 Sudrabin et al. ..... 204/197

*Primary Examiner*—Bruce F. Bell

*Attorney, Agent, or Firm*—Fay, Sharpe, Beall, Fagan, Minnich & McKee, LLP

[57] ABSTRACT

Non self-passivating cathodic protection anode materials such as graphite and high silicon iron are treated to improve corrosion resistance. Anodically stable oxide coatings such as cobalt oxide (cobalt spinnel) or precious metal oxides are received on the underlying anode substrate. The rate of consumption of the anode material during the operation of the cathodic protection system is dramatically reduced.

17 Claims, No Drawings

CATALYTICALLY COATED ANODES

This Appln claims benefit of Provisional Appln 60/029, 529 Oct. 31, 1996.

BACKGROUND OF THE INVENTION

The present invention is directed to the development of improved anode materials for use in cathodic protection systems.

Anodes used in cathodic protection systems are hooked to a positive side of a power supply such as a DC rectifier, a battery charger or an AC to DC converter. The positive connection causes the anode material to undergo an anodic reaction wherein the anode material tends to dissolve and be consumed. An anode is a site where there is a loss of bonding electrons. The anode material ionizes (i.e., the material corrodes and an oxidation reaction occurs).

In the case of cathodic protection, it is desirable to select as the anode a material that is reluctant to corrode. At the same time, it is desirable that an alternative reaction occur such that anions (negatively charged ions such as hydroxide ions or chloride ions) are attracted to the surface of the anode material.

In cathodic protection, preferably negatively charged ions, which are attracted to the surface of the anode, release their electrons into the anode from which the power supply then pumps them into the cathode to keep the cathode from corroding. It is the imparting of electrical charge from the anode through the pump or DC convertor into the cathode that raises the energy level of the cathode structure (i.e., raises its energy level) and keeps it from corroding.

There are, then, two sides to the cathodic protection circuit, the cathode side and the anode side. Although there is a benefit to the cathode side, it is common to have destruction on the anode side, resulting from either the dissolving of the anode material or the corrosion of the electrolyte. If the anode material is gold or platinum, the primary reaction will not constitute dissolving gold or platinum. Rather, chloride or hydroxide ions from the electrolyte will be attracted to the surface. When they reach the surface, electrons are stripped off and the ions are converted into gas. In the case of chlorine ions the reaction is:

$$2Cl^- \rightarrow Cl_2 + 2e^-$$

In the alternative, the anode material itself may be dissolved. For example, in the case of an anode comprised nearly entirely of iron, the dominant reaction is the dissolving of the iron such that very little $Cl_2$ gas is generated. The consumption rate of non-alloyed, non-catalyzed iron is about 20 pounds per ampere year.

Catalytic coatings are known for use on self healing valve metal substrates to improve the corrosion resistance of those substrates. For example, oxides of iridium, rubidium, ruthenium, and other precious metal oxide coatings can be applied to valve metal substrates such as the tantalum, niobium, and titanium family of metals ("valve metals"). The precious metal coatings used on such metal substrates are oxides. Hence, they are already corroded, but they are electrically conductive. Since they are already corroded, they become, to one degree or another, stable when the underlying material is intended to be operated as an anode. The substrates are driven as an anode and they tend to form an oxide layer which acts as an insulator. A protective oxide film is developed and does not permit any current discharge from the surface. It is a non-conductive oxide. But, if a conductive oxide is included on most of the surface of the substrate metal, and the oxide is scratched such that the metal substrate is exposed, then corrosion activity tends to occur there. The conductive oxide quickly conforms to an oxide of that metal at that location, and it stops discharging there. Discharge continues where the precious metal oxide coating is intact or where the metal oxide is conductive.

In addition to valve metals, graphite and high silicon iron are commonly used anode materials with relatively low consumption rates. They are much less expensive than valve metals and offer, in general, a consumption rate of about 1 to 2 lbs per ampere year in comparison to iron which is consumed at 20 lbs per ampere year. But in some instances it is desirable to have an even longer consumption rate to avoid periodic repairs to the cathodic protection system or to increase the current at which the system is run.

Thus, it has become desirable to improve the durability of the graphite and high silicon iron anode materials so that the consumption rate is improved. The improved anodes can be used for increased durations or be run at higher current densities.

BRIEF DESCRIPTION OF THE INVENTION

The present invention is directed to improved anodes for cathodic protection. An underlying anode substrate comprises a member selected from the group consisting of high silicon iron (i.e., iron alloyed with about 14.5% silicon) and graphite. An anodically stable oxide coating such as cobalt oxide (cobalt spinnel) or a precious metal oxide is applied on the underlying anode substrate. The rate of consumption of the anode substrate material during the operation of the cathodic protection system is dramatically reduced.

An advantage of the present invention is that the rate of corrosion of the anode is reduced. This allows for the anode to be useful in its cathodic protection environment for significantly longer time periods than the non-catalyzed counterparts. Alternatively, the cathodic protection system can be run at higher current densities than would otherwise be possible without excessive anode consumption rates.

Another advantage is that the graphite and high silicon iron anode materials are significantly less expensive than self healing valve metal substrates that are often used as anode materials in cathodic protection systems. Hence, a user will see a cost reduction in replacing the valve metal anodes with graphite or high silicon iron anodes catalyzed with cobalt oxide or precious metal oxides.

Other advantages will become apparent to those skilled in the art upon a reading of the detailed description below.

DETAILED DESCRIPTION OF THE INVENTION

The present invention is directed to the use of anodically stable oxide coatings on low consumption rate cathodic protection anodes such as graphite and high silicon iron electrodes. The improvements include enhanced durability of the electrodes and a reduced consumption rate.

High silicon cast iron was originally invented by the Duriron Company of Dayton, Ohio. Duriron makes two primary alloys. One is called Duriron and that is primarily made out of 14.5% silicon cast iron. The other is called Durachlor 51 which, in addition to 14.5% silicon, contains about 4.5% chromium and about 0.7% molybdenum at higher concentrations than the original Duriron alloy. Those metals are cast into pieces that are used as anodes in underground and in sea water applications for cathodic protection where they can be operated as anodes. They have been used in this application for years. As used herein, "high silicon iron" refers to iron containing at least about 10% silicon, and includes both Duririon and Durachlor.

Anode materials such as high silicon iron and graphite have low consumption rates on the order of 1–2 pounds per ampere year. It has been discovered that by coating these low consumption anode materials with an appropriate catalytic oxide coating, the consumption rate of the electrode is decreased roughly tenfold. Performance is enhanced. The reaction tends to force the consumption of the electrolyte rather than the anode itself.

The reaction that occurs in salt water is primarily:

$$2Cl^- \rightarrow Cl_2 + 2e^-$$

The fresh water reaction is primarily:

$$OH^- \rightarrow 2H_2O + O_2 + 4e^-$$

The fresh water reaction is the type that typically occurs under ground, while the salt water reaction occurs in sea water. The consumption rate in each environment will differ, with the consumption rate in fresh water somewhat greater than salt water.

In the case of high silicon iron in a conventional underground environment, about 1 pound of material is consumed for every amp of current flow, with the remaining electrons coming from the consumption of either hydroxy ions or chloride ions in the electrolyte. In comparison, ordinary iron consumes at the rate of 20 pounds per ampere year. So there is a 95% reduction in the consumption rate just by alloying the iron material. In the case of graphite, the consumption rate is somewhere between 1 and 2 pounds. Carbon resists corrosion particularly in chloride environments (salt water). In fresh water, it consumes at nearly its full Faradaic rate.

As far as consumption is concerned, if there is 1 amp of current then 1–2 pounds of the anode material are consumed over a year. Over 10 years, 10–20 pounds are consumed, and over 2 years 20–40 pounds are consumed. If the anode weighs 20 pounds, it will last only 10–20 years.

The application of a catalytic coating to the low consumption anodes such as high silicon iron (including its significant cobalt and molybdenum formulations) or graphite allows for options in operations. The catalytically coated anode can be operated at 2 or 3 times the current density. Alternatively, the usual current density can be used to operate the anode, but the anode will sustain a 2–3 times longer life over the non-coated counterpart. Either way is beneficial depending on the circumstances. For example, if a structure is only intended to be used for 10 years, then it may be beneficial to run the anode at a higher current density.

Cathodic protection systems of the type discussed herein are primarily used in conjunction with cathodically protecting such objects as underground pipelines and off shore production platforms and piping. Other examples include underground storage tanks, water storage tanks, water treatment units, steel reinforced concrete structures and other areas where cathodic protection is used.

Catalytic coatings used in the present invention have been known for use on valve metal substrates like titanium, aluminum, zirconium, niobium (columbium) and tantalum. However, the coatings have not before been used on traditional low consumption rate anodes such as high silicon iron (and its chromium and molybdenum) and graphite.

In the past, precious metal or precious metal oxides, both of which are typically in the platinum family of metals, were coated on valve metal substrates. Platinum has a low dissolution rate, on the order of a few micrograms per ampere year. The substrate metal serves as the anodic current carrier while virtually all current is transferred between the anode and the surrounding electrolyte only at surfaces were the coating is intact. If the coating is scraped off and the substrate is exposed to the environment, the substrate will passivate or form an oxide film, thus directing the current to flow where the platinum is located. A passivating film forms, thus protecting the substrate from failing.

Platinum and the other precious metal oxides are too expensive to use as the entire anode; hence the platinum was used as a coating. The platinum was not useful over substrates like steel because if the platinum were scratched the steel would corrode and the anode would fail. Platinum has been useful on a valve metal such as titanium. Here, if the platinum is scratched, a self healing nonconductive tenacious film forms outside.

Precious metal oxides (for example ruthenium, rubidium and iridium oxides) have been used as coatings on valve metals. For some time. Cobalt oxide has also been used on valve metals. Use of valve metals such as titanium as substrates is very expensive. Titanium costs on the order of 12–15 dollars per pound. High silicon iron, in comparison, is about 0.50/lb. In many instances, high silicon iron and graphite anode materials are preferred over valve metals. They are less expensive and are typically used in situations where a larger sized anode is required. The desired anodes are often on the order of several inches in diameter by 50–100" long. The application of a catalytic coating to these materials is novel.

Cobalt oxide ($Co_3O_4$), commonly referred to as cobalt spinnel, is a commonly used catalytic coating for valve metal substrates. In addition to the precious metal oxides, the cobalt spinnel is probably one of the best performing of the non-precious metal type semi-conductor oxide coatings that will allow current to transfer across it without actually corroding itself. So, it remains stable when driven as an anode and yet it still wants to let current exchange across its surface, which is desirable in the anodic reaction. Also, of all of the different coatings that behave this way (e.g., the precious metal oxides, the cobalt spinnel, and other oxides such as lead oxide, nickel oxide and magnetite) are all black in color.

The present invention involves applying primarily these preferred black oxide coatings or other precious metal oxide coatings to some of the existing anode materials, such as graphite and high silicon iron. The preferred coating for the high silicon iron or graphite anode substrates is cobalt oxide. The precious metal oxides are also useful coatings.

Without treatment, the silicon iron anode is not porous. While the coating may be applied to the silicon iron anode by painting and the anode will show improved corrosion results, it is desirable to treat the silicon iron surface to make it porous. There are different ways of doing this. The surface may be sand blasted or acid etched in advance to retain the catalytic coating thereon. In addition, the high silicon iron may be formed by sintering so as to enhance the penetration of the coating into the anode. Another alternative to making the surface porous is to arc spray or flame spray the outer surface of high silicon iron with a layer of silicon or high silicon iron. The cast spraying technique will cause the surface to be somewhat porous and hence retain the catalytic coating better than a smooth nonporous surface.

Graphite, on the other hand, is already porous. The present inventor contemplates different techniques for applying the catalytic coating material to graphite anodes. The coating can be brushed on, but this will primarily affect only the surface. The graphite anode can be submerged in the coating solution, and this will allow a greater penetration into the material. Another process for coating the graphite involves applying the coating in an autoclave where a vacuum is pulled and the coating solution is placed in the chamber. When the vacuum is released the coating would be forced into the graphite for improved penetration. The coating is then converted to an oxide according to a baking procedure discussed below.

Preferably, the catalytic coating is cobalt oxide. The cobalt oxide coating is prepared by dissolving reagent grade $CO(NO_3).6H_2O$ to give a cobalt concentration of 2.5 moles per liter. The coating is then applied to the underlying anode material, either by brushing, immersion, autoclave, spraying, or other method of application. Once the anode material is coated with the cobalt oxide coating it is placed in an oven and baked at a suitable temperature for a sufficient amount of time in an open air environment to covert the nitrate to cobalt oxide.

In addition to cobalt oxide, other cathodic coatings would work well on silicon iron or graphite anodes. Precious metal oxides, though more expensive, work well, as does cobalt oxide. Blends of these oxides may also be used. While the catalytic coatings described herein, primarily the cobalt oxide and the precious metal oxides, have been used on valve metals in the past, there has been no teaching of using the same coatings on silicon iron or graphite. In contrast to the valve metals, the high silicon iron and graphite are not self healing, and hence there has been no incentive to test the catalytic coatings on such anode materials.

EXAMPLES

Example 1

Two high silicon iron anodes were tested. The anodes that were treated had the dimensions of 1.125" in diameter by 4.5" in length. A portion of one of the tubes was immersed in a cobalt nitrate solution prepared by immersing reagent grade $CO(NO_3)_2.6H_2O$ in a sufficient amount of acetone to give a cobalt concentration of 2.5 moles per liter of solution. The anode was removed from the solution to air dry. It was then placed in an oven and baked to convert the cobalt nitrate to cobalt oxide.

A consumption rate test was conducted to determine the durability of the cobalt oxide coated High silicon iron anode against a non-coated high silicon iron anode. In so doing, two small 3.5" diameter, 8" high glass beakers were filled to a depth of 3" with a solution of 0.2 M $Na_2SO_4$. Both anodes were weighed. The coated high silicon iron anode was placed in one beaker, and the non-coated anode was placed in the second beaker. The sulfate environment simulates oxygen generation in fresh water.

A test current of 150 mA was applied to achieve a current density of 2 amperes per square foot. The tests ran for 70 days. Electrical contact was made above the liquid level to ensure accurate weight measurements at the conclusion of the testing period.

After 70 days the anodes were removed from the solutions and allowed to dry. They were then measured to determine weigh loss. The results are shown below:

| Solution | Current Density A/ft$^2$ | Cata-lyzed? | Weight Loss, grams | Consumption g/A-yr |
|---|---|---|---|---|
| 0.2 M $Na_2SO_4$ | 2.0 | no | 7.30 | 253.7 |
| 0.2 M $Na_2SO_4$ | 2.0 | yes | 0.74 | 25.7 |

Example 2

Two high silicon iron anodes were tested. The anodes that were treated had the dimensions of 1.125" in diameter by 4.5" in length. A portion of one of the tubes was immersed in a cobalt nitrate solution prepared by immersing reagent grade $Co(NO_3)_2.6H_2O$ in a sufficient amount of acetone to give a cobalt concentration of 2.5 moles per liter of solution. The anode was removed from the solution to air dry. It was then placed in an oven and baked to convert the cobalt nitrate to cobalt oxide.

A consumption rate test was conducted to determine the durability of the cobalt oxide coated high silicon iron anode against a non-coated high silicon iron anode. In so doing, two small 3.5" diameter, 8" high glass beakers were filled to a depth of 3" with a solution of 0.5 M NaCl. Both anodes were weighed. The coated high silicon iron anode was placed in one beaker, and the non-coated anode was placed in the second beaker. The chloride environment simulates sea water.

A test current of 150 mA was applied to achieve a current density of 2 amperes per square foot. The tests ran for 70 days. Electrical contact was made above the liquid level to ensure accurate weight measurements at the conclusion of the testing period.

After 70 days the anodes were removed from the solutions and allowed to dry. They were then measured to determine weigh loss. The results are shown below:

| Solution | Current Density A/ft$^2$ | Cata-lyzed? | Weight Loss, grams | Consumption g/A-yr |
|---|---|---|---|---|
| 0.5 M NaCl | 2.0 | no | 0.56 | 21.0 |
| 0.5 M NaCl | 2.0 | yes | 0.01 | 0.4 |

Example 3

Two standard graphite anodes were obtained and pre-weighed. One of the graphite anodes was to remain the control, and hence was not catalyzed. The second was catalyzed with a cobalt oxide coating. A portion of one of the graphite anodes was immersed in a cobalt nitrite solution prepared by immersing reagent grade $Co(NO_3)_2.6H_2O$ in a sufficient amount of acetone to give a cobalt concentration of 2.5 moles per liter of solution. The anode was removed from the solution to air dry. It was then placed in an oven and baked to convert the cobalt nitrate to cobalt oxide.

A consumption rate test was conducted to determine the durability of the cobalt oxide coated graphite anode against a non-coated graphite anode. Two small 3.5" diameter, 8" high glass beakers were filled to a depth of 3" with a solution of 0.2 M $Na_2SO_4$. Both anodes were weighed. The coated graphite anode was placed in one beaker, and the non-coated graphite anode was placed in the second beaker. The sulfate environment simulates oxygen generation in fresh water.

A test current of 150 mA was applied to achieve a current density of 2 amperes per square foot. The tests ran for 70 days. Electrical contact was made above the liquid level to ensure accurate weight measurements at the conclusion of the testing period.

After 70 days the anodes were removed from the solutions and dried. However, because the graphite anodes are porous in comparison to high silicon iron anodes, the graphite anodes had to be soaked in water to dissolve out the salt from the solution. Then they were allowed to dry. After several cycles of dissolving the salt and drying the anode until the anode was void of salt and dry, they were measured to determine weight loss and hence corrosion. The results are shown below:

| Solution | Current Density $A/ft^2$ | Catalyzed? | Weight Loss, grams | Consumption g/A-yr |
|---|---|---|---|---|
| 0.2 M $Na_2SO_4$ | 2.0 | no | 69.24 | 2406.1 |
| 0.2 M $Na_2SO_4$ | 2.0 | yes | 26.61 | 924.9 |

Example 4

The test of Example 3 was repeated on two additional graphite anodes. However, the electrolyte was changed to 0.5 M NaCl to simulate sea water. As in example 3, the porous graphite anodes had to be soaked in water and dried over several cycles to ensure a true weight loss could be determined. The results are as follows:

| Solution | Current Density $A/ft^2$ | Catalyzed? | Weight Loss, grams | Consumption g/A-yr |
|---|---|---|---|---|
| 0.5 M NaCl | 2.0 | no | 0.9 | 73 |
| 0.5 M NaCl | 2.0 | yes | 0.07 | 3.7 |

All four of the above examples show a significant reduction in weight loss (hence corrosion resistance) when the anodes are catalyzed with a cobalt oxide coating. Similar results are expected with the use or precious metal oxides as coatings over graphite or high silicon iron anodes.

The invention has been described with reference to the preferred embodiment. Obviously, modifications and alterations will occur to others upon a reading and understanding of this specification. It is intended to include all such modifications and alterations insofar as they come within the scope of the appended claims or the equivalents thereof.

I claim:

1. An anode, comprising:

an underlying porous anode substrate comprising a member selected from the group consisting of high silicon iron or graphite; and a coating consisting essentially of an anodically stable oxide received on and within said underlying porous anode substrate to reduce the rate of consumption of the anode material during operation.

2. An anode, as set forth in claim 1, wherein the high silicon iron anode is comprised of a sintered material.

3. An anode, as set forth in claim 1, wherein the high silicon iron anode comprises a sprayed porous surface.

4. An anode, as set forth in claim 1, wherein the high silicon iron anode comprises an etched outer surface.

5. An anode, as set forth in claim 1, wherein the oxide coating on the anode is cobalt oxide or a blend of cobalt oxide and other oxides.

6. An anode, as set forth in claim 1, wherein the oxide coating on the anode is a precious metal oxide or a blend of precious metal oxides and cobalt oxide.

7. An anode, as set forth in claim 1, wherein the oxide coating on the anode is a precious metal oxide selected from the group consisting of platinum oxide, ruthenium oxide, iridium oxide, and rubidium oxide.

8. An anode, as set forth in claim 1, wherein the high silicon iron comprises at least about 10% silicon.

9. An anode, as set forth in claim 1, wherein the high silicon iron comprises at least about 10% silicon as well as manganese and chromium.

10. An anode as set forth in claim 1, wherein the oxide coating on the anode is a cobalt oxide.

11. An anode as set forth in claim 1, wherein the oxide coating on the anode is a blend of oxides selected from the group of precious metal oxides and cobalt oxide.

12. An anode, comprising a porous core anode comprised of iron and at least about 10% silicon, and a catalytic coating comprising cobalt oxide.

13. An anode, as set forth in claim 12, wherein the cobalt oxide coating is obtained by applying a cobalt nitrate solution to the core anode and heating the same to convert the cobalt nitrate to cobalt oxide.

14. An anode, comprising a graphite anode, and a catalytic coating comprising cobalt oxide obtained by applying a cobalt nitrate to the graphite anode and heating the same to a sufficient temperature and for a sufficient time to convert the cobalt nitrate to cobalt oxide.

15. An anode, as set forth in claim 14, wherein the cobalt oxide coating is obtained by applying a cobalt nitrate solution to the core anode and heating the same to convert the cobalt nitrate to cobalt oxide.

16. An anode, comprising:

a non self-passivating porous anode material substrate selected from the group consisting of graphite and high silicon iron, the high silicon iron including at least about 10% silicon therein; and an anodically stable oxide coating received on and within the pores of said porous anode material substrate for reducing a rate of consumption of said anode material in fresh and salt water environments.

17. An anode comprising a substantially porous high silicon iron substrate, with an anodically stable catalytic oxide coating retained on and within said porous substrate.

* * * * *